United States Patent [19]

Olesen

[11] Patent Number: 5,076,483

[45] Date of Patent: Dec. 31, 1991

[54] HOUSING MOUNTED POWERED STAPLER FOR STAPLING VARIABLE STACK

[75] Inventor: Paul Olesen, Safety Harbor, Fla.

[73] Assignee: Swingline Inc., Long Island City, N.Y.

[21] Appl. No.: 602,452

[22] Filed: Oct. 23, 1990

[51] Int. Cl.[5] ..... B27F 7/17

[52] U.S. Cl. ..... 227/131; 227/142; 227/155

[58] Field of Search ..... 227/90, 88, 7, 131, 227/142, 155

[56] References Cited

U.S. PATENT DOCUMENTS

| | | | |
|---|---|---|---|
| 3,282,489 | 11/1966 | March | 227/131 X |
| 4,199,095 | 4/1980 | Yamanoi | 227/155 X |
| 4,542,844 | 9/1985 | Olesen et al. | 227/7 |
| 4,593,847 | 6/1986 | Hagemann | 227/155 |
| 4,623,082 | 11/1986 | Kurosawa | 227/131 X |
| 4,720,033 | 1/1988 | Olesen | 227/131 |
| 4,726,505 | 2/1988 | Okazaki | 227/155 X |
| 4,844,319 | 7/1989 | Kurosawa | 227/155 X |
| 4,913,332 | 4/1990 | Olesen | 227/131 |

*Primary Examiner*—Frank T. Yost
*Assistant Examiner*—Rinaldi Rada
*Attorney, Agent, or Firm*—Pennie & Edmonds

[57] ABSTRACT

A powered stapler mechanism with a pivotal head mounted in a housing comprised of an upper portion and a lower portion including a lower floor and upstand structure to which the mechanism is anchored. The pivotal head is raised by cam means during the stapler cycle and the housing portions are lockable together using an axle and a slide lock.

6 Claims, 8 Drawing Sheets

FIG.5b
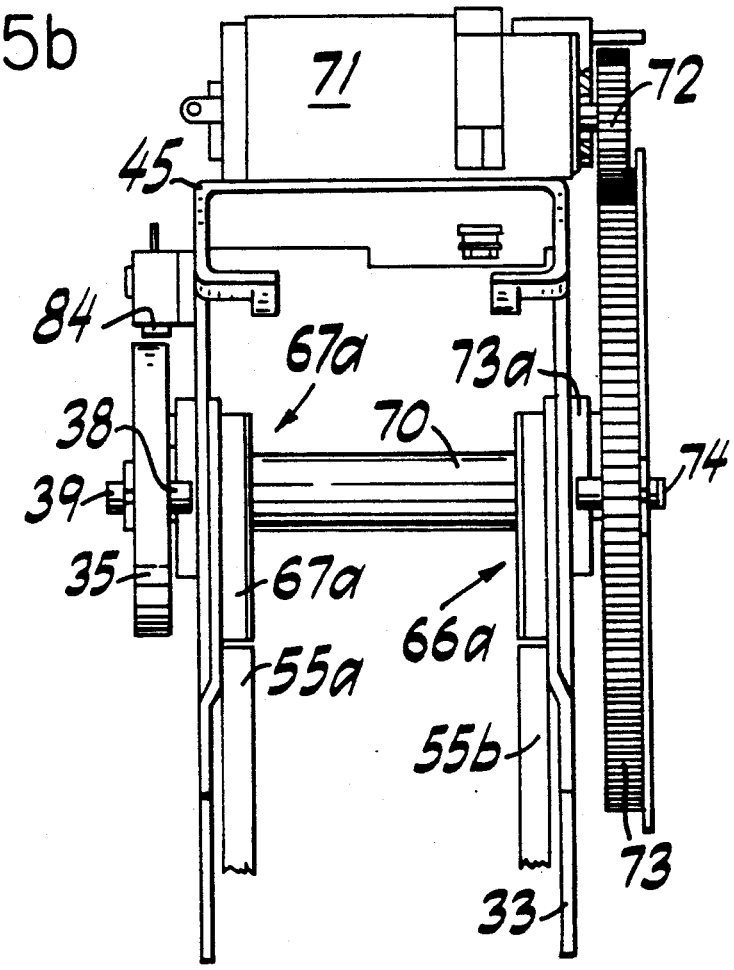
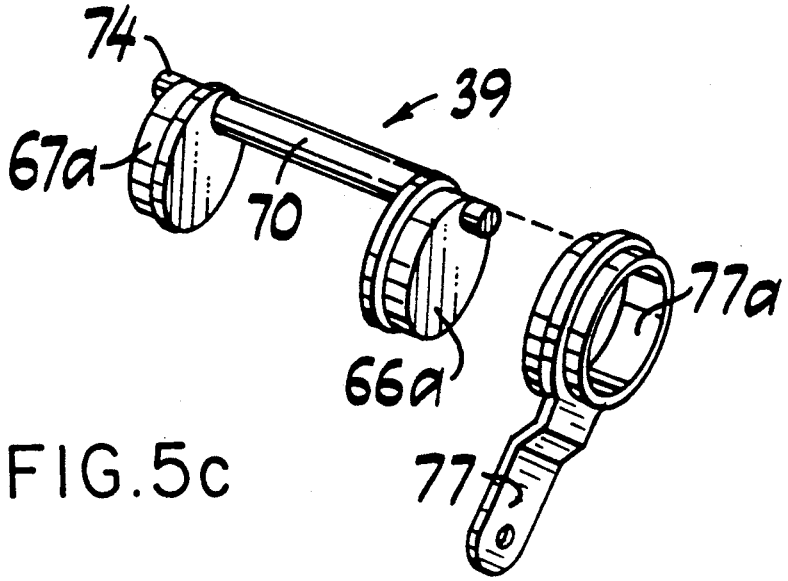
FIG.5c

HOUSING MOUNTED POWERED STAPLER FOR STAPLING VARIABLE STACK

BACKGROUND OF THE INVENTION

Prior housed power staplers have included those shown in U.S. Pat. No. 4,720,033 in which a drive-control unit powers the stapler blade down to staple and then back up again. Other powered staplers are disclosed in U.S. Pat. No. 4,542,844 and an unjamming arrangement is shown in U.S. Pat. No. 4,913,332.

Housed staplers for selectively stapling multiple sheets heretofore have failed to achieve full success in stapling stacks employed in heavy duty applications.

SUMMARY OF THE INVENTION

Broadly, the present invention is a housed stapler which comprises (1) a stationary base plate supported on a lower housing portion (2) a lockable, removable upper housing portion for locking to the lower housing (3) a clinching anvil unit (4) control means for lifting the stapler head above the anvil unit to accommodate for variable stacks of paper from thin to thick stacks (5) a rotatable eccentric to limit raising of the stapler head and (6) pivotal eccentric-pin actuating means for moving the actuator for rotating clinching wings of the clinching anvil unit.

It is a feature of the invention that long legged staples are provided seriatim which staples are useful in stapling thin (2 or more sheets) and thick stacks (70 or more sheets) since offset leg bending is accomplished after, rather than during, leg penetration of the stack.

BRIEF DESCRIPTION OF THE INVENTION

FIG. 1 is a perspective view of the base portion of the housing supporting the stapler mechanism base frame and axle;

FIG. 1*a* is a sectional view along line 1*a*—1*a* of FIG. 1;

FIG. 2 is a side elevational perspective view of the base portion and upper housing portions of the stapler housing in its locked position;

FIG. 2*a* is a partial enlarged detail of the rear lock in an unlocked position;

FIG. 2*b* is a sectional view along line 26—26 of FIG. 2;

FIG. 2*c* is a detail of the axle arrangement for locking with the upper housing;

FIG. 3 is a plan view of the mechanism frame including its base plate and staple leg clincher;

FIG. 3*a* is an elevational view along line 3*a*—3*a* of FIG. 3;

Figure 5A:
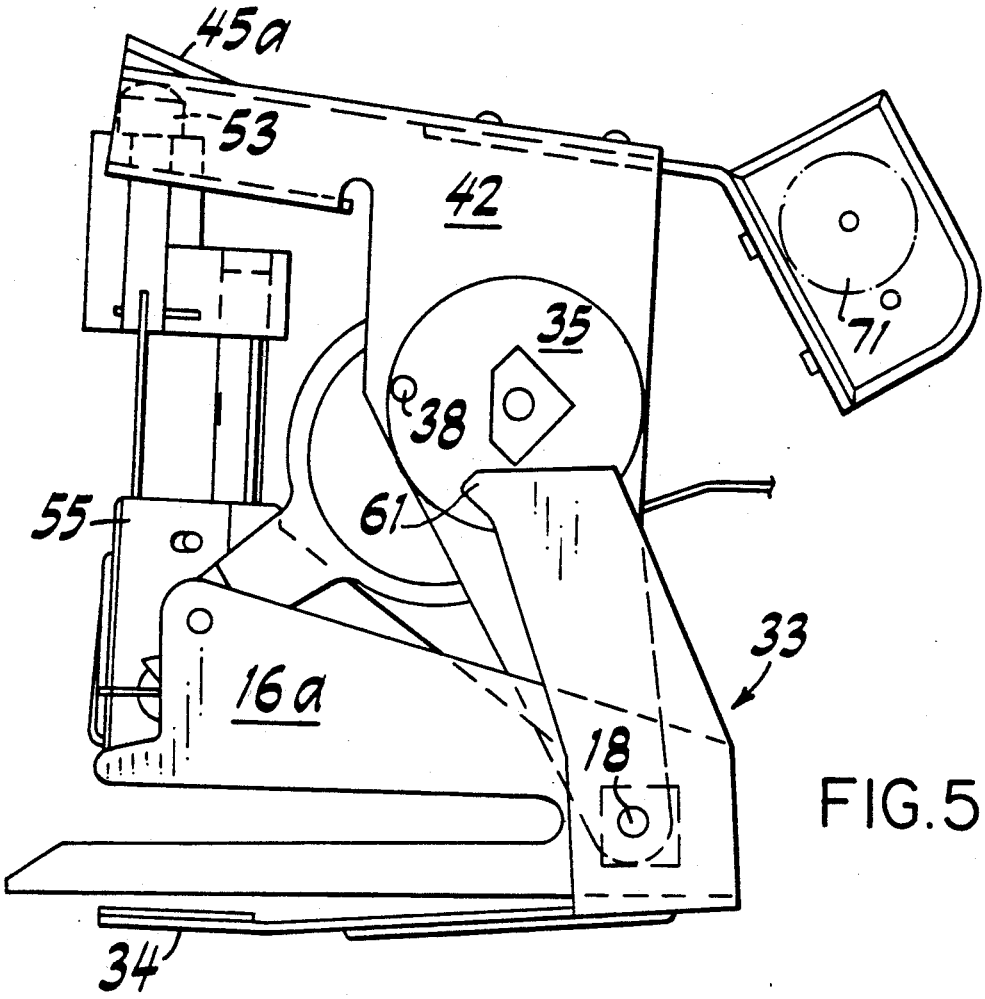
FIG. 5 is a side elevational view of the stapler mechanism in the down, staple-penetrating position.
Figure 5D:
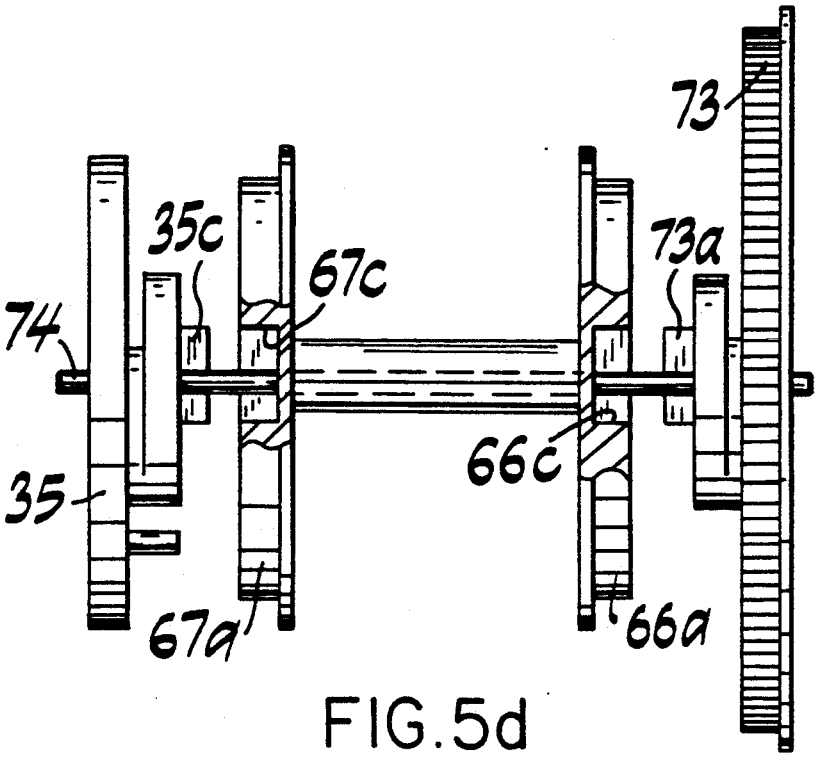
Figure 6:
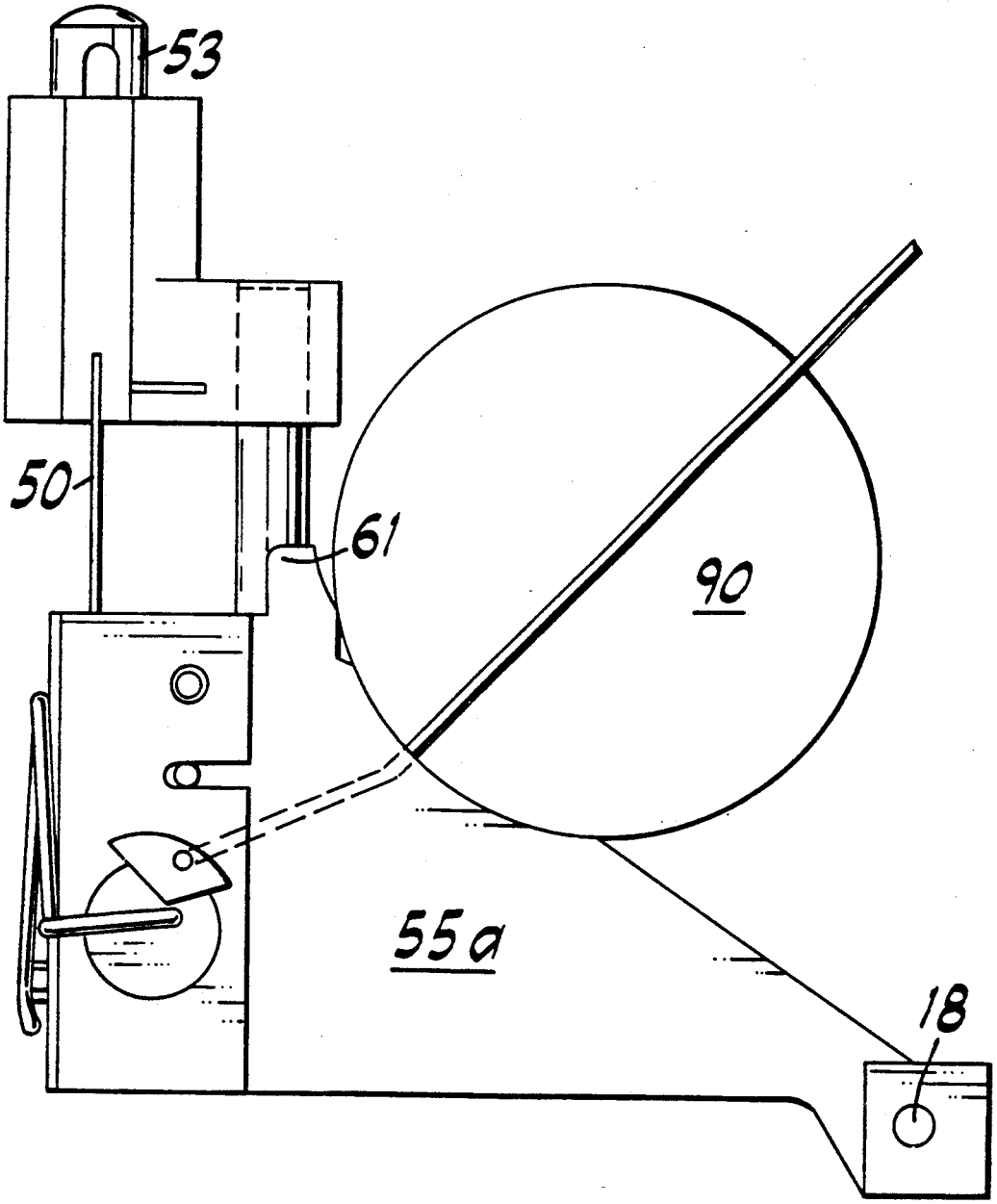
Figure 7:
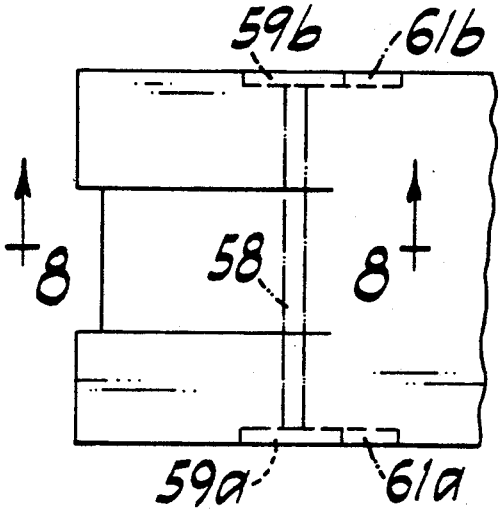

FIG. 5*a* is a side elevational view of the stapler mechanism in its up position;

FIG. 5*b* is an end elevational view of the stapler mechanism with arms omitted;

FIG. 5*c* is a perspective view of the stapler mechanism power eccentric arrangement;

FIG. 5*d* is an exploded elevational view of a portion of the stapler mechanism;

FIG. 6 is a side elevational view of the stapler head, sheath and cartridge;

FIG. 7 is a plan view of the variable head lifter mechanism; and

Figure 8:
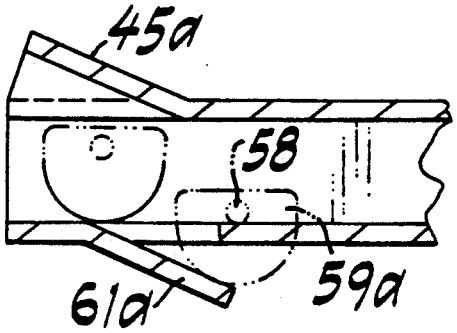

FIG. 8 is a sectional view along line 8—8 of FIG. 7.

DESCRIPTION OF THE PREFERRED EMBODIMENT

Viewing first FIGS. 1-5, the powered stapler 10 includes housing 10*a* consisting of a lower housing portion 11 and upper housing portion 12. The housing 10*a* is preferably made of molded plastic but may be of any suitable material. Stapler mechanism base frame 13 (FIGS. 3 and 4) is secured to the structure of the lower housing portion 11 and upper housing 12 is removably secured to lower portion 11 as further described. Lower housing 11 includes floor 11*a* which normally rests on a desk, table or similar surface. Housing portion 11 also has decorative horizontal ridge 11*b*.

Figure 1:
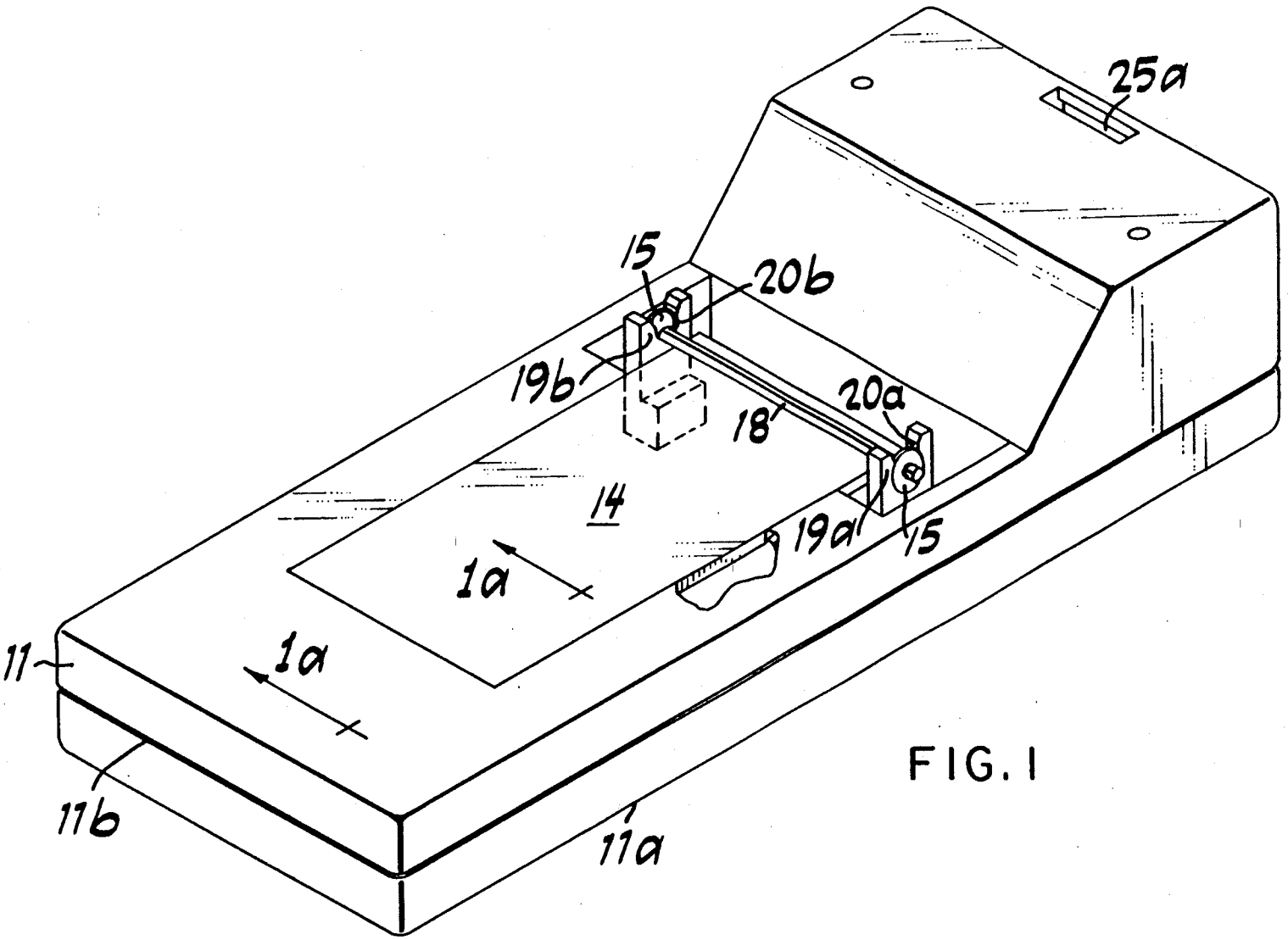
Figure 2:
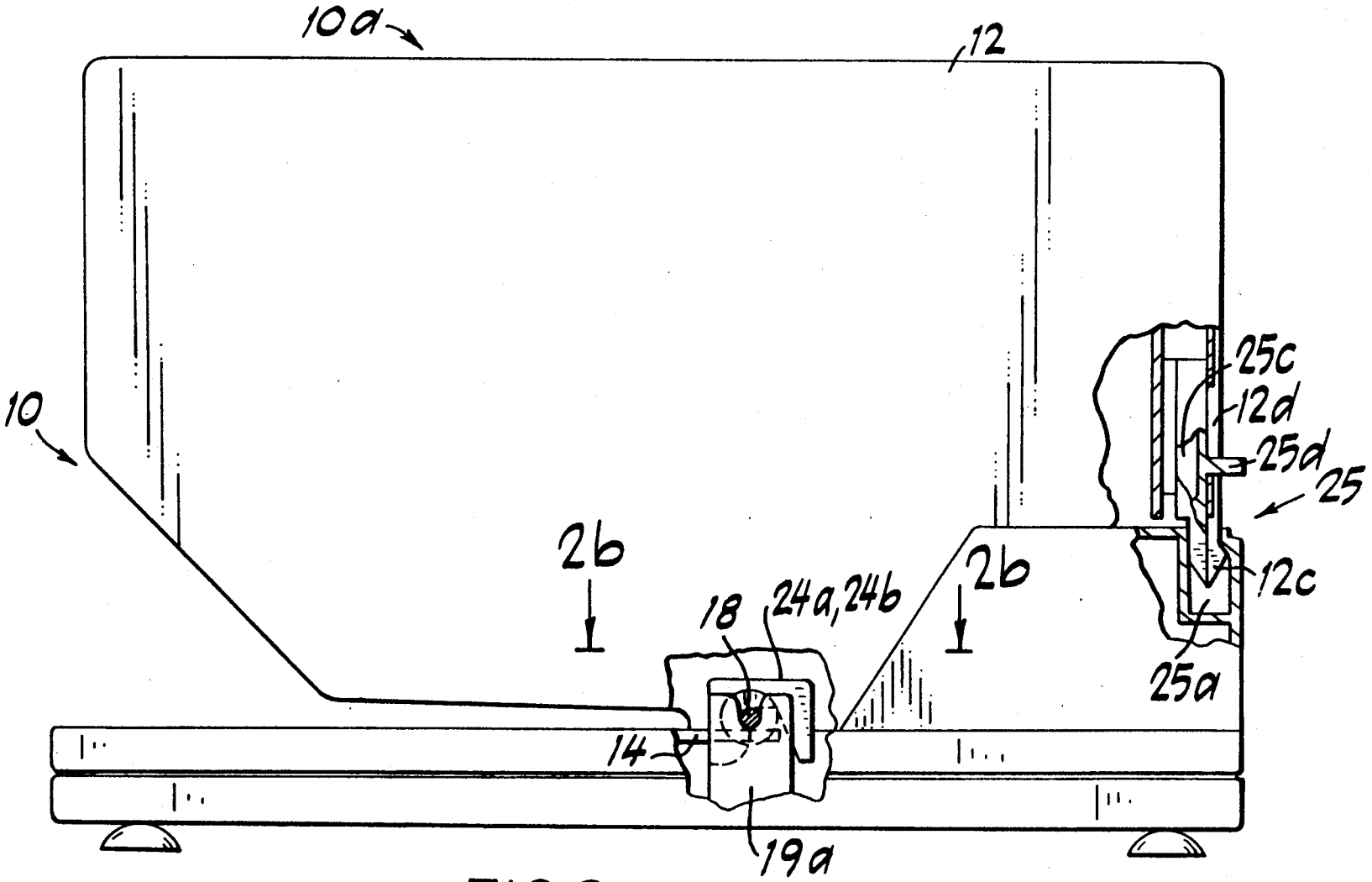
Figure 1A:
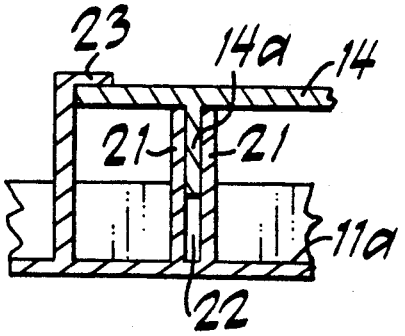
Figure 2A:
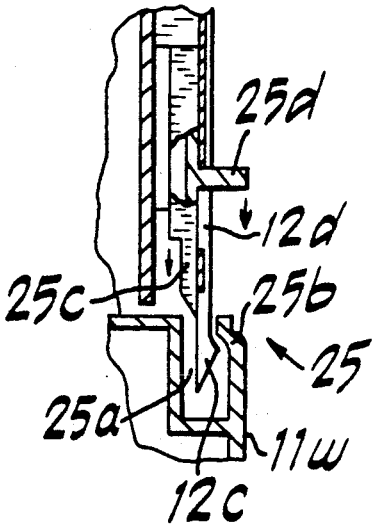
Figure 2B:
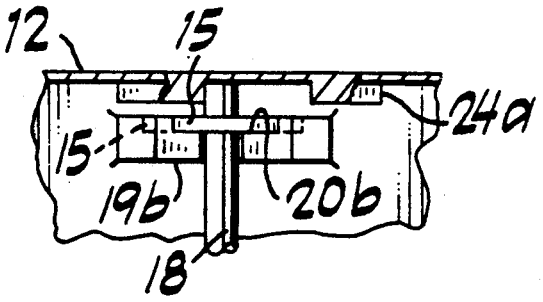

Stapler mechanism base frame 13 includes anchor plate 14 (FIG. 1), anchor prong 14*a* (FIG. 4) and side pieces 16*a*, 16*b* with holes 17*a*, 17*b* for receiving mechanism mounting axle 18. Plate 14 rests in upstanding lower housing journal mounts 19*a*, 19*b* and upstanding forward support 21 which mounts 19*a*, 19*b* and support 21 rise from lower housing floor 11*a* (FIG. 1*a*). Axle 18 is held on mounts 19*a*, 19*b* by round clinch washers 15 which are located in round mount recesses 20*a*, 20*b*. Recesses 20*a*, 20*b* are shaped so that once washers 15 are secured to axle 18 and positioned in recesses 20*a*, 20*b* washers 15 cannot be moved upwardly by lifting or pulling upwardly axle 18 (FIG. 2*b*). Anchor plate 14 prong 14*a* fits into slot 22 of forward upstanding support 21. Hold-down lip 23 arising out of floor 11*a* prevents plate 14 from moving upwardly once assembled (FIG. 1*a*). Plate 14 is thus anchored structurally directly to floor 11*a* for greater stability and rigidity.

Figure 2C:
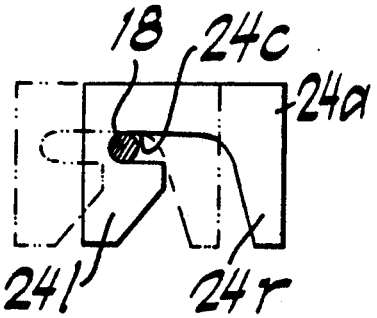

Upper housing 12 carries lock configurations 24*a*, 24*b* on each side of housing 12. During assembly housing 12 is manipulated onto and around the ends of axle 18 and is held by axle 18 against lifting off of upper housing 12 when the housing is translated forward and thereafter held forward by latch 25 (FIGS. 2, 2*a* and 2*b*). Axle 18 enters left hand configurations 24*a*, 24*b* between throat sides 24*r*, 24*l* and is captured in configuration offset lobe 24*c* when housing 12 is translated forward (FIGS. 2*b* and 2*c*). Right hand configuration 24*b* is similarly constructed to receive the other end of axle 18.

Turning to FIG. 2*a*, latch 25 includes housing recess 25*a* in lower housing portion 11 which recess 25*a* includes a catch cam lip 25*b* on its rear wall 11*w*. Upper housing portion 12 has angled projection 12*c* on its rear wall 12*d*. Adjacent on rear wall 12*d* is mounted slide 25*c* with thumb pusher 25*d* which upon insertion of projection 12*c* against complementary stationary lip 25*b* is lowered into recess 25*a* by pushing on pusher 25*d*. When both projection 12*c* and slide 25*c* occupy recess 25*a* projection 12*b* cannot be withdrawn from recess 25*a* thus providing a lock function.

Figure 3:
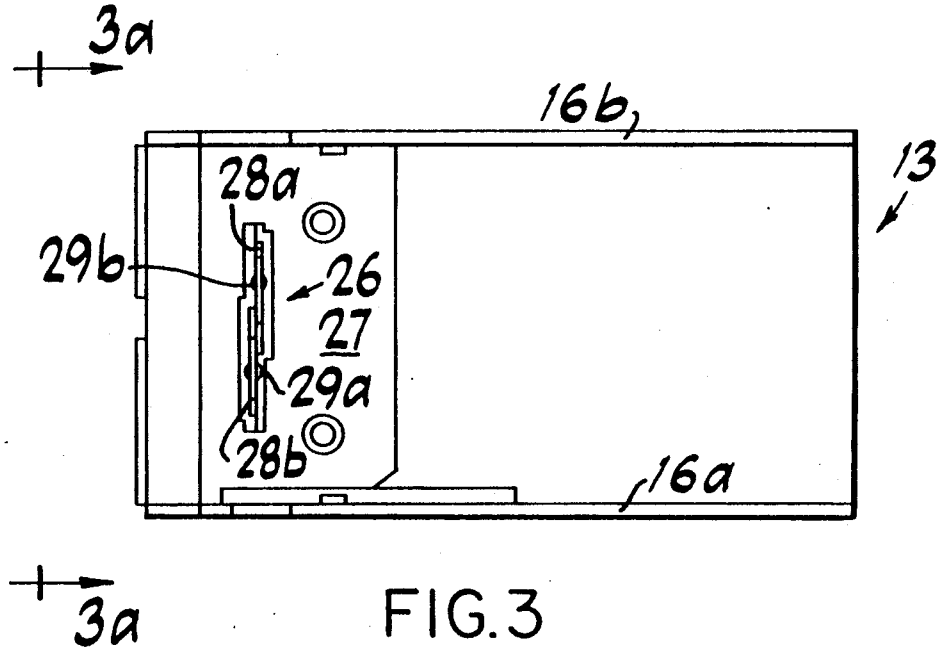
Figure 4:
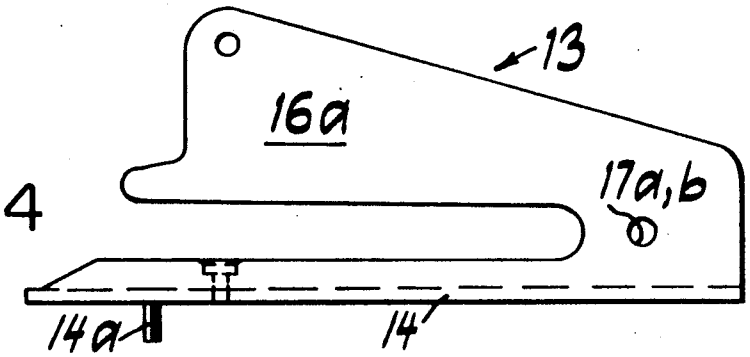
FIG. 4 is a side elevational view of the mechanism frame.
Figure 3A:
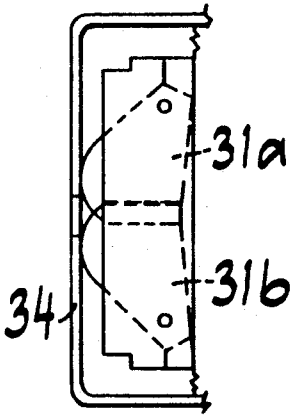

Turning now to FIGS. 3 and 3*a*, staple leg receiving and bending unit 26 includes horizontal anvil plate 27, angled slots 28*a*, 28*b*, leg-guide funnels 29*a*, 29*b* and pivotal leg-bending clinch wings 31*a*, 31*b*. Wings 31*a*, 31*b* are operated by kicker plate 34 of actuator unit 33. FIG. 4 shows frame 13 including side pieces 16*a*, 16*b* and mount projection 14*a*.

Figure 5:
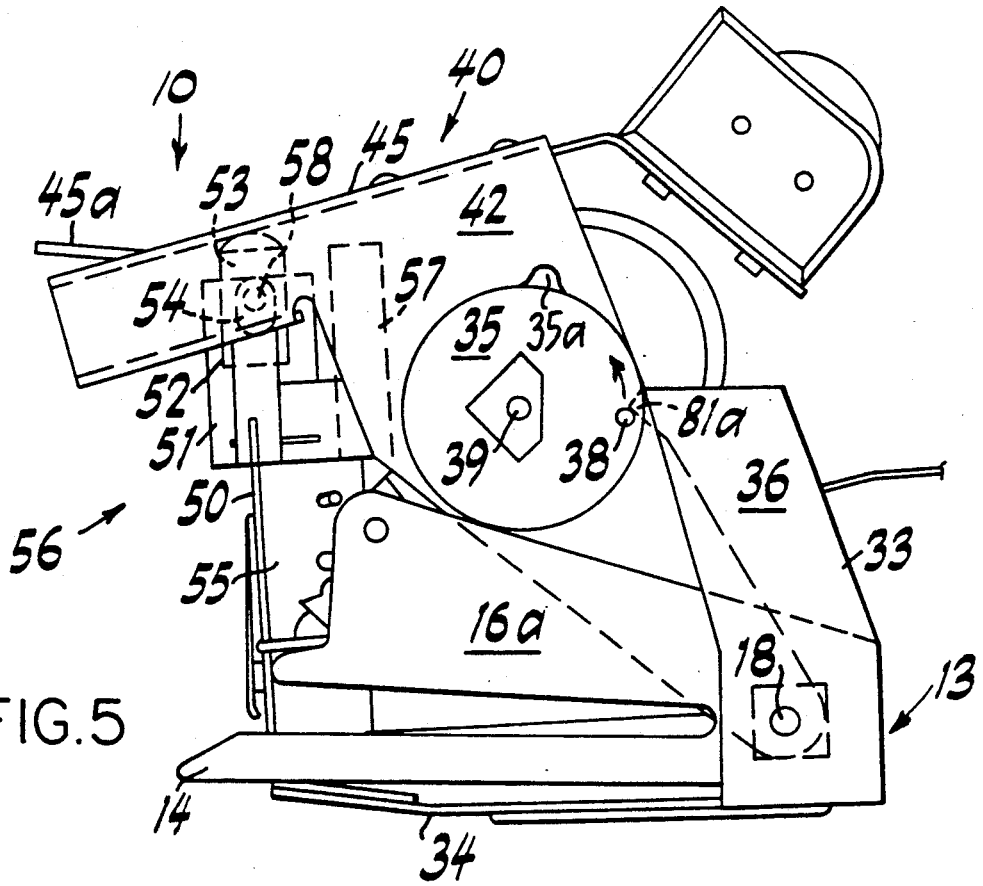

With respect to FIG. 5, frame 13 carries pivotal clinch wing actuator unit 33 about axle 18. Actuator unit 33 includes kicker plate 34 and upstanding two side pieces 36 with cam section 81*a* on side piece 36 to engage exterior cam pins 38 carried on cam 35 to cause, as further explained, partial rotation up and down of actuator unit 33 to accomplish in a timely fashion staple leg binding.

Drive control unit 40, also pivotal about axis 18, includes two side frame pieces 42 and top piece 45. Top piece 45 includes angled bend-up center piece 45*a* to permit wider opening (up to 7/16") of stapler 10 for stacks up to 70 sheets for stapling. Also shown is driving blade 50, driver blade housing 51, housing cavity 52, button head 53 and head slot 54. Housing 51, its blade 50 and related parts comprise a staple drive unit 56 which rides up and down on post 57 which in turn is mounted on staple head 55 which is pivotal about axis 18. Head 55 has two spaced apart sides 55*a*, 55*b* (see FIGS. 5 and 5*a*). Drive control unit 40 is driven up and down by dumbbell-arm eccentric 39 which in turn is rotated by bull gear 73.

Referring to FIGS. 7 and 8, cross pin 58 and its semicircular end cams 59*a*, 59*b* serve to lift staple drive unit 56 and housing head 55 back upward after stapling has been completed. Cams 59*a*, 59*b* ride on cam tracks 61*a*, 61*b* to raise the stapler unit 56 and head 55 to accommodate thick stacks of paper. Stapler head 55 with walls 55*a*, 55*b* carries projection 61 which limits head 55 upward travel when engaged by eccentric as described (FIGS. 5*b* and 6).

In FIGS. 5*b*, 5*c* and 5*d* there is shown top piece 45 supporting motor 71, spur gear 72, bull gear 73. Dumbbell unit 39 rotates about shaft 74 with discs 66*a*, 67*a* forming with cross tube 70 one integral piece. Disc 66*a* is interlocked through lock piece 73*a* and recess 66*c* to bull gear 73. Cam 35 is shown with inner lock piece having lock projection 35*c* which locks into recess 67*c* of disc 67*a* so that the cam 35 and disc 67*a* rotate together about axle 74. Two arms (one omitted from the drawings for clarity) 77, with eyelet openings 77*a* surround discs 66*a*, 67*a*. As the arms 77 swing through their arc during a cycle of the stapler mechanism, arms 77 engage portion 61 of staple head 55 to limit the body upward movement during the return portion of the cycle. Also shown is cam 35 with inner lock piece 35*c* which interlocks with disc 67*a*, to turn with it. Since arms 77 surround discs 66*a*, 67*a*, the arms engage head 55 to limit its upward movement. Arms 77 are omitted from FIG. 5*b* for clarity.

In the operation of the stapler mechanism, the first step is to insert cartridge 90 loaded with a strip of staple blanks of sufficient size for forming staples capable of securing together 70 sheets or more. Then, a stack of papers from 2 to 70 or more sheets is introduced into stapler 10 between the anvil plate 27 and the staple head 55. When trip-switch (not shown) in the vicinity of stapler head 55 is moved, the stapling cycle is started. Motor 71 rotates spur gear 72 which rotates bull gear 73 causing dumbbell unit 39 to turn about shaft 74. As unit 39 rotates it causes eccentric plastic discs 66*a*, 66*b* to turn causing drive control unit 40 to swing downwardly about axle 18.

As drive control unit 40 moves downwardly, top cross piece 45 including angled center vent piece 45*a* pushes down on, and slides along the top of, button 53 causing stapler head 55, also pivotal about axle 18, to descend down onto the top of the stack of paper sheets to be stapled.

As the stapling cycle continues the driver blade 50 drives the lead staple with its formed legs through the paper stack. Once the staple legs have passed through the stack they are guided by funnels 29*a*, 29*b* into slots 28*a*, 28*b* until the staple crown engages the top sheet of the stack. At this point in the cycle, clinching wings 31*a*, 31*b* are driven upwardly to bend the legs to clinch the stack. Clinching wings 31*a*, 31*b* are caused to pivot and clinch by pivotal actuation of cam wheel 35 carrying projecting pin 38 which pin 38 engages portion 81*a* of side piece 36 of actuator unit 33 to rotate unit 33 clockwise as viewed in FIGS. 5 and 5*a*. Kicker plate 34 of unit 33 drives wing 31*a*, 31*b* upwardly to clinch (FIG. 5). Cam wheel 35 includes raised portion 35*a* which engages switch 84 to deenergize the stapler at the end of its cycle (FIGS. 5 and 5*b*).

Once stapling is complete, drive control unit 40 commences its upward travel with staple head 55 being lifted by driver blade 50 until the eccentric 39 with arms 77 engage head sides 55*a* and 55*b* and limit its upward movement. Driver blade 50 continues to be lifted by cross pin 58 which includes cross pin cams 59*a*, 59*b* mounted on the ends of pin 58. Cams 59*a*, 59*b* ride on cam follower tracks 61*a*, 61*b* to raise the button 53 and blade 50 until the button 53 enters the area above top plate 45 and below the angled piece 45*a*. At this point, the cycle ends as switch 84 is operated to end the cycle and stop the mechanism.

I claim:

1. A housed power stapler having a stapler mechanism including a head and head moving means for stapling two or more sheets and having a housing with a lower portion and an upper portion comprising a) lower housing portion having a floor and spaced-apart support mount means upstanding on such floor;

b) an anchor frame plate and axle positioned on and supported by such support mount means which anchor frame plate and axle in turn supports the stapler mechanism which in turn comprises a pivotal head, a stapler drive unit slidable within and above the head;

c) an anvil unit on the anchor frame plate;

d) head means for moving the head up and down;

e) means for feeding seriatim formed staples with uniform crowns and legs for driving;

f) a clinching means in the anvil unit including wings for clinching the staple legs to secure two or more sheets with the same size staple; and g) latch means including a housing recess and a housing projection engageable in such recess and including further recesses in the upper housing for engaging said axle to releasably hold the upper and lower housing portions together.

2. The power stapler of claim 1 in which the head moving means includes cam lifting means for lifting the stapler drive unit during the stapling cycle.

3. The power stapler of claim 1 in which the head moving means include eccentric means to limit lifting of the stapler head.

4. The power stapler of claim 1 in which the latch means includes a recess in the lower housing portion and slidable means on the upper housing portion which once moved through sliding into said recess locks the upper and lower portions together.

5. The power stapler of claim 1 in which the head moving means for moving the head up and down includes a motorized drive control means including eccentric disc and follower means for moving the stapler head and stapler drive unit through a cycle including downwardly during a portion of the cycle and upwardly during the remainder of the cycle which drive control means provide power for forming and driving staples seriatim including means for driving the blade down and lifting it back up to create a wide opening between the anvil unit and the stapler head.

6. The power stapler of claim 1 in which the upstanding space-apart support means are spaced a sufficient distance to accommodate movement of said clinching means below the frame plate.

* * * * *